US012715651B2

(12) United States Patent
Benedetti

(10) Patent No.: US 12,715,651 B2
(45) Date of Patent: Aug. 25, 2026

(54) PRESSED WOOD PALLET FOR THE SUPPORT OF MANUFACTURED ARTICLES

(71) Applicant: IMAL S.r.l., Modena (IT)

(72) Inventor: Paolo Benedetti, Modena (IT)

(73) Assignee: IMAL S.r.l., Modena (IT)

( * ) Notice: Subject to any disclaimer, the term of this patent is extended or adjusted under 35 U.S.C. 154(b) by 70 days.

(21) Appl. No.: 18/842,033

(22) PCT Filed: Feb. 28, 2023

(86) PCT No.: PCT/IB2023/051856

§ 371 (c)(1),
(2) Date: Aug. 27, 2024

(87) PCT Pub. No.: WO2023/166416

PCT Pub. Date: Sep. 7, 2023

(65) Prior Publication Data

US 2025/0171199 A1 May 29, 2025

(30) Foreign Application Priority Data

Mar. 2, 2022 (IT) ..... 102022000003866

(51) Int. Cl.
*B65D 19/00* (2006.01)

(52) U.S. Cl.
CPC .. *B65D 19/004* (2013.01); *B65D 2519/00029* (2013.01); *B65D 2519/00034* (2013.01);
(Continued)

(58) Field of Classification Search
CPC .. B65D 2519/00935; B65D 2519/0094; B65D 2519/0096
See application file for complete search history.

(56) References Cited

U.S. PATENT DOCUMENTS 4,674,414 A * 6/1987 Nulle ..... B65D 19/004 108/901
5,341,748 A * 8/1994 Liu ..... B65D 19/40 108/53.3

(Continued)

FOREIGN PATENT DOCUMENTS

CZ 2016413 A3 11/2017
DE 9217413 U1 4/1994

(Continued)

*Primary Examiner* — Daniel J Rohrhoff
(74) *Attorney, Agent, or Firm* — ASLAN LAW, P.C.

(57) ABSTRACT

A pallet that includes at least one main body made of a mixture of loose wooden material and adhesive materials, made in a single body piece and provided with a holding base intended to receive and support one or more manufactured articles. The pallet includes one upper face defining at least one containment seat open at the top, bounded by an upper edge and having a bottom wall; and one lower face opposite the upper face; where the containment seat has at least one abutment surface positioned between the upper edge and the bottom wall so as to define a housing seat of an overlying pallet and the lower face includes at least one contact surface adapted to contact the abutment surface of an underlying pallet, where, in a stacking configuration, the lower face remains lifted with respect to the bottom wall of the underlying pallet.

13 Claims, 3 Drawing Sheets

(52) U.S. Cl.
CPC ..... *B65D 2519/00039* (2013.01); *B65D 2519/00064* (2013.01); *B65D 2519/00069* (2013.01); *B65D 2519/00074* (2013.01); *B65D 2519/00268* (2013.01); *B65D 2519/00288* (2013.01); *B65D 2519/00318* (2013.01); *B65D 2519/00338* (2013.01); *B65D 2519/0096* (2013.01)

(56) References Cited

U.S. PATENT DOCUMENTS

| | | | | | |
|---|---|---|---|---|---|
| 5,667,065 | A * | 9/1997 | Fahrion | B65D 21/0215 | 206/599 |
| 5,996,508 | A * | 12/1999 | Constantino | B65D 19/0018 | 108/57.25 |
| 6,220,183 | B1 * | 4/2001 | Schwitzky | B65D 19/40 | 108/53.5 |
| 2004/0134390 | A1 * | 7/2004 | Apps | B65D 19/38 | 108/53.1 |
| 2018/0099779 | A1 * | 4/2018 | Apps | B65D 19/04 | |
| 2019/0367213 | A1 * | 12/2019 | Benedetti | B30B 11/027 | |
| 2021/0039830 | A1 | 2/2021 | Kalinowski et al. | | |
| 2022/0250793 | A1 * | 8/2022 | Daubenspeck | B65D 19/003 | |

FOREIGN PATENT DOCUMENTS

| | | | |
|---|---|---|---|
| DE | 202005011693 | U1 | 11/2005 |
| ES | 1004488 | U | 10/1988 |
| ES | 2035774 | A1 | 4/1993 |
| WO | 2018115278 | A1 | 6/2018 |

* cited by examiner

PRESSED WOOD PALLET FOR THE SUPPORT OF MANUFACTURED ARTICLES

CROSS-REFERENCE TO RELATED APPLICATIONS

This application claims priority to IT patent application No. 102022000003866 filed on Mar. 2, 2022, and this application claims priority to and is a 371 of international PCT Application No. PCT/IB2023/051856 filed on Feb. 28, 2023, the entire contents of which are hereby incorporated by reference.

TECHNICAL FIELD

The present invention relates to a pressed wood pallet for the support of manufactured articles.

BACKGROUND ART

In a variety of industries, the use of pallets to support materials is well known. Among the well-known types of pallets, pressed wood pallets have many advantages, including the fact that they can be easily stacked on top of each other and be extremely lightweight, making them extremely convenient to store and transport.

Specifically, pressed wood pallets of known type are made in the form of a one-piece main body obtained by means of forming a mixture of loose wooden material mixed with adhesive materials.

The pallets of known type have at least one upper face intended to accommodate the manufactured articles and at least one lower face opposite the upper face.

The upper face defines at least one containment seat which is open at the top and adapted to receive the lower face of another pallet.

Generally, the lower face has a plurality of support feet which allow the pallet to rest on the ground and which, in a stacking configuration, are intended to fit within the aforementioned containment seats.

In particular, the pallets of known type are conformed so that when stacked on top of each other, the upper face of one of them is arranged to rest on the lower face of an overlying pallet, allowing a large number of pallets to be stacked.

However, such conformation and mode of coupling make subsequent operations of mutual separation of pallets difficult, especially through the use of special transfer vehicles, such as forklift or pallet trucks.

Known pallets, in fact, first need to be separated manually and then placed on the ground for pickup by means of the transfer vehicles.

In addition to this, known pallets frequently define a coupling by interlocking which requires considerable effort on the part of the operator to make the separation thereof.

Such drawbacks, in addition to leading to a lengthening in operational timelines, can also lead to damage and/or breakage of one or more pallets, resulting in increased production costs.

DESCRIPTION OF THE INVENTION

The main aim of the present invention is to devise a pressed wood pallet for the support of manufactured articles which allows practical and easy separation from a plurality of pallets stacked on top of each other.

Another object of the present invention is to devise a pressed wood pallet for the support of manufactured articles which allows one or more pallets to be conveniently and easily picked up from a plurality of pallets stacked on top of each other, including through the use of special transfer vehicles.

A further object of the present invention is to devise a pressed wood pallet for the support of manufactured articles which requires minimal effort by the operator to separate a plurality of pallets stacked on top of each other.

Still one object of the present invention is to devise a pressed wood pallet for the support of manufactured articles which prevents the pallets from being broken and/or damaged during the separation operations of the pallets themselves.

Another object of the present invention is to devise a pressed wood pallet for the support of manufactured articles which can overcome the aforementioned drawbacks of the prior art within the framework of a simple, rational, easy and effective to use as well as cost-effective solution.

The aforementioned objects are achieved by this pressed wood pallet for the support of manufactured articles having the characteristics of claim 1.

BRIEF DESCRIPTION OF THE DRAWINGS

Other characteristics and advantages of the present invention will become more apparent from the description of a preferred, but not exclusive, embodiment of a pressed wood pallet for the support of manufactured articles, illustrated by way of an indicative, yet non-limiting example, in the attached tables of drawings in which.

EMBODIMENTS OF THE INVENTION

Figure 1:
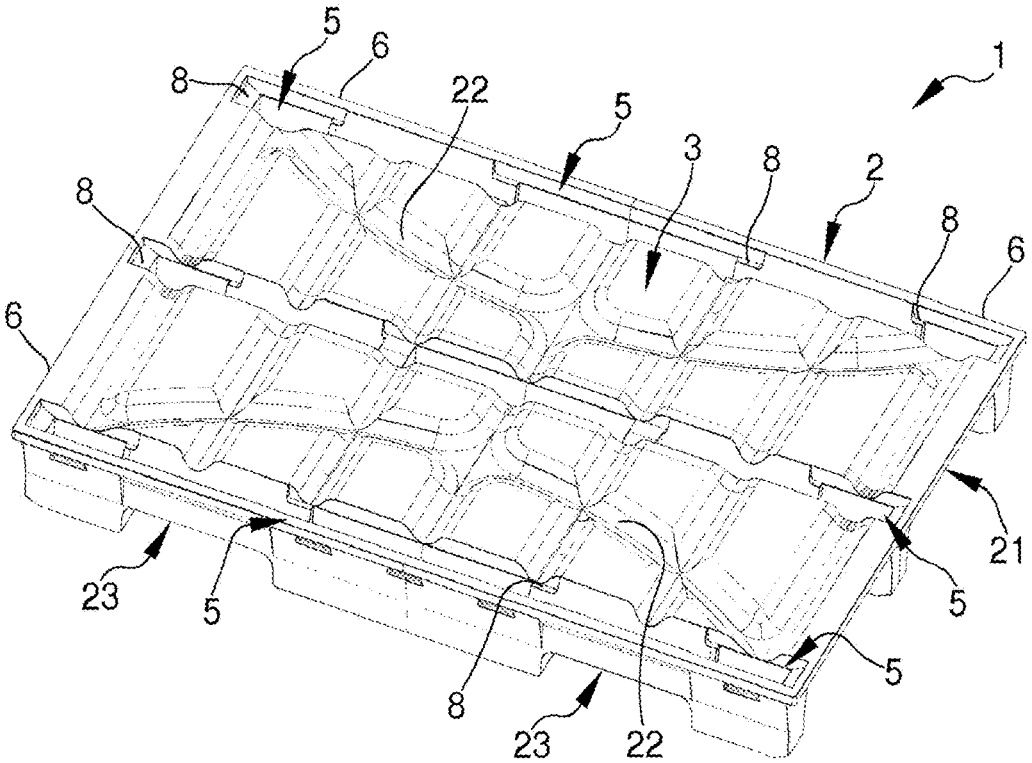
FIG. 1 is an axonometric view of a pallet according to the invention, showing the upper face of the pallet itself.
Figure 2:
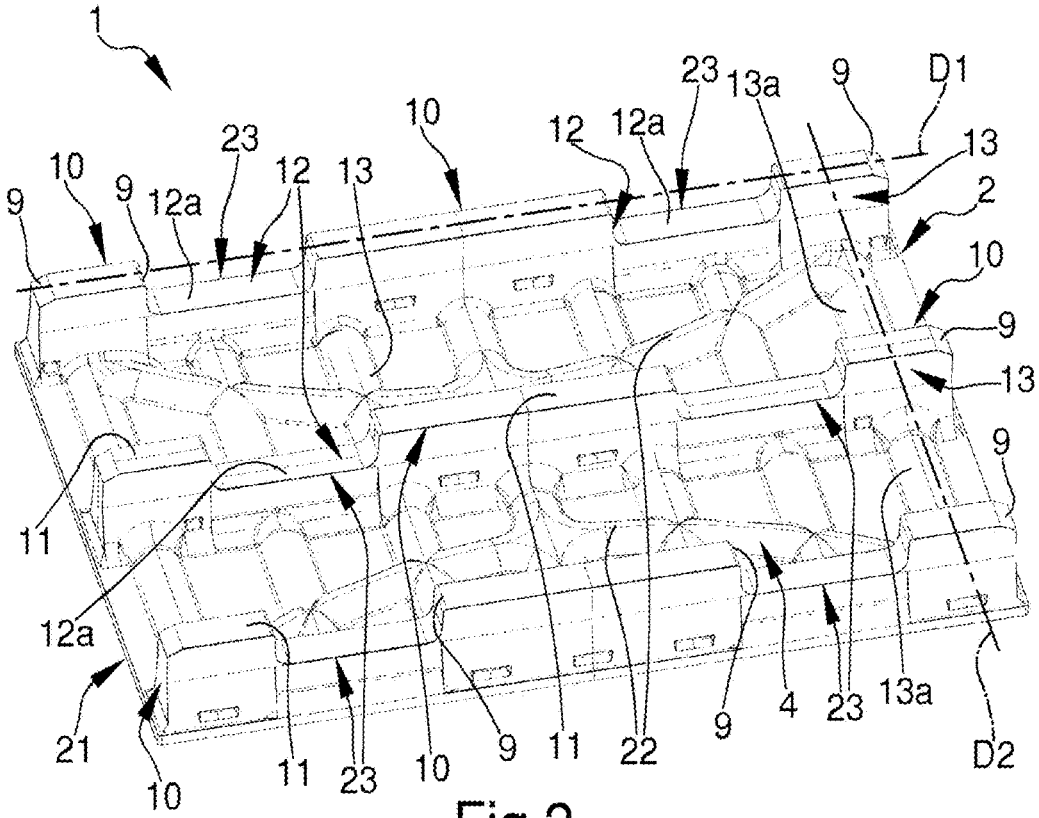
FIG. 2 is an axonometric view of the pallet in FIG. 1, showing the lower face of the pallet itself.
Figure 3:
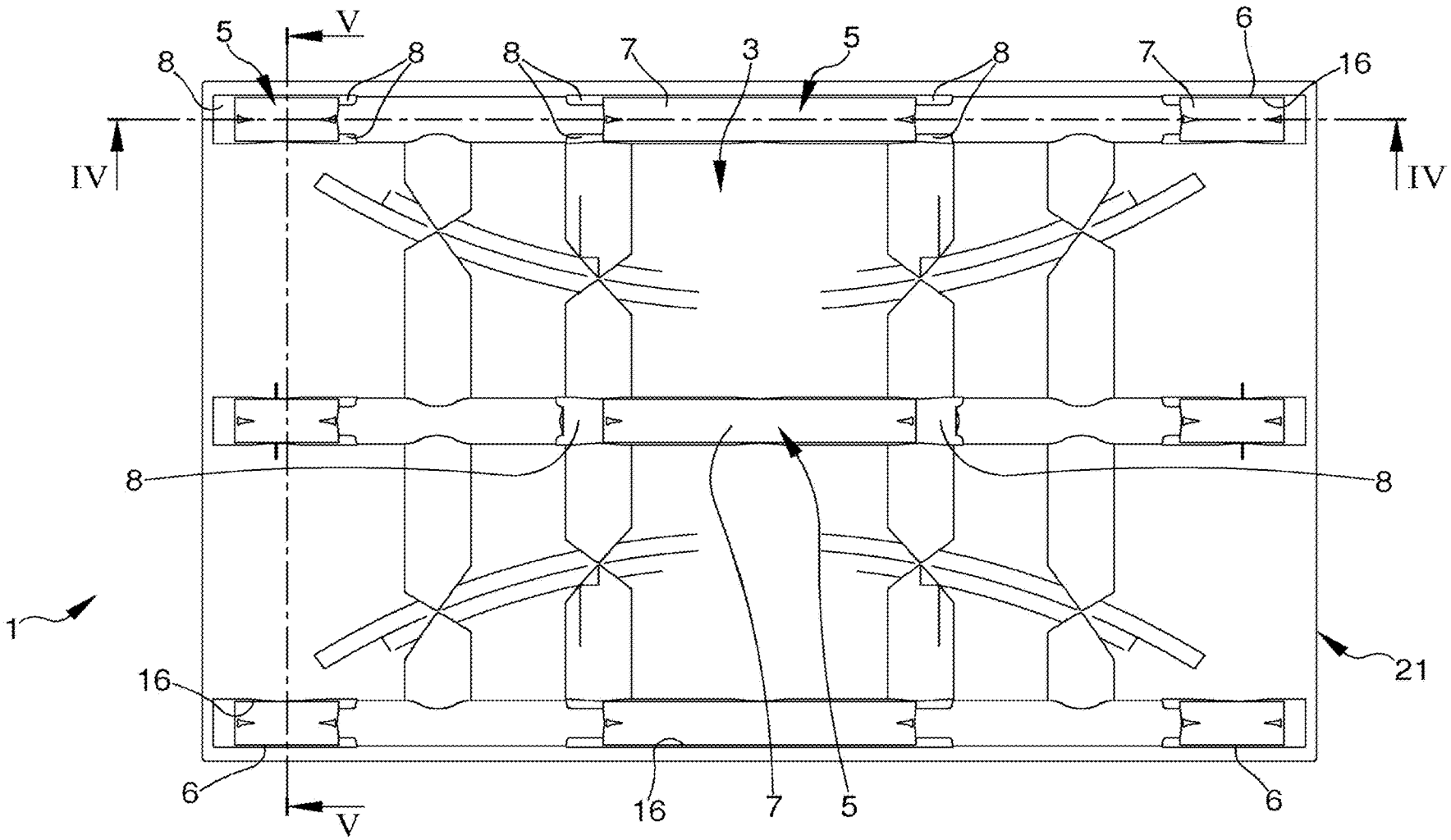
FIG. 3 is a plan view from above of a plurality of pallets according to the invention in a stacking configuration.
Figure 4:
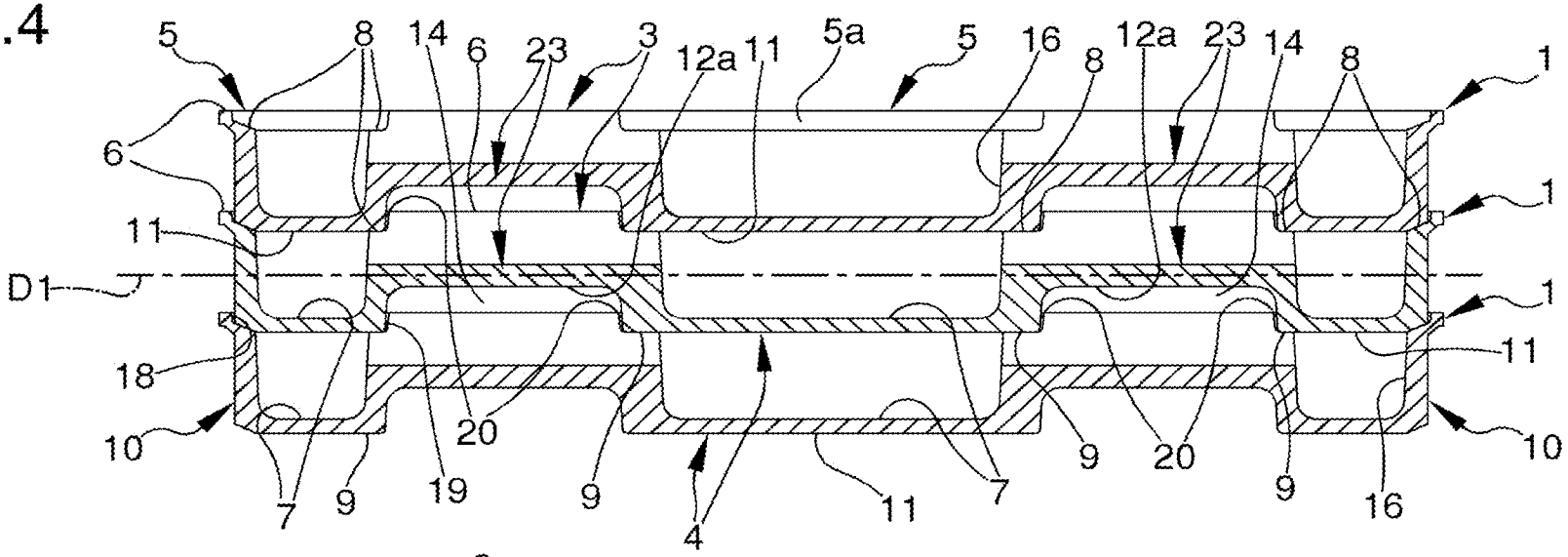
FIG. 4 is a sectional view along the IV-IV plane in FIG. 3.
Figure 5:
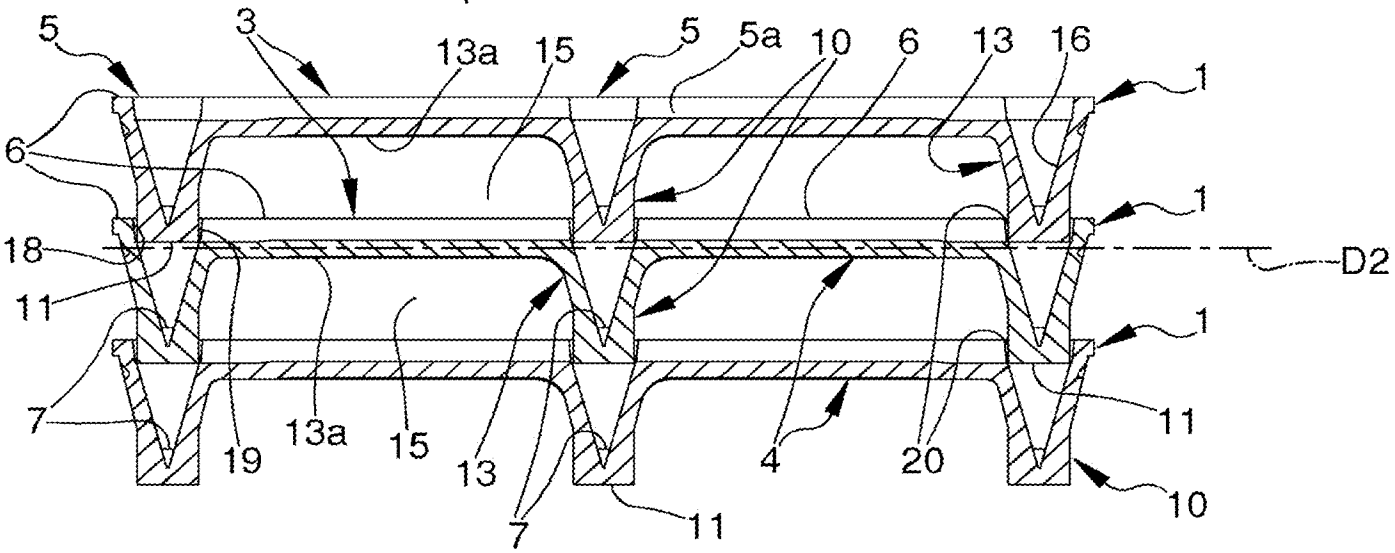
FIG. 5 is a sectional view along the V-V plane in FIG. 3.

With particular reference to these figures, reference numeral 1 globally denotes a pallet 1 made of pressed wood for the support of manufactured articles.

The pallet 1 comprises at least one main body 2 made of a mixture of loose wooden material and adhesive materials.

The main body 2 is made in the form of a single body piece. In more detail, the main body 2 is made in the form of a one-piece body obtained by pressing and forming, in a manner known to the industry technician, the mixture of wooden material and adhesives.

The main body 2 comprises a holding base 21 intended to receive and support one or more manufactured articles.

The holding base 21 comprises at least one upper face 3 and at least one lower face 4 opposite the upper face 3.

In use, the upper face 3 faces upwards, while the lower face 4 faces downwards.

The main body 2 also comprises a plurality of stiffening beads 22 formed into the holding base 21 and adapted to impart high load-bearing capacity and mechanical strength to the pallet 1 while maintaining reduced thickness of the holding base itself.

The stiffening beads 22 are made so that the thickness of the holding base 21 is substantially even.

The stiffening beads 22 also have the function of containing any spillage coming from the manufactured articles.

For this purpose, the stiffening beads 22 define a series of concavities on the upper face 3 and a series of corresponding convexities on the lower face 4.

In accordance with a preferred embodiment, the stiffening beads 22 are communicating with each other.

The upper face 3 defines at least one containment seat 5 open at the top, bounded by an upper edge 6 and having a bottom wall 7.

According to the invention, the containment seat 5 has at least one abutment surface 8 positioned between the upper edge 6 and the bottom wall 7 so as to define a housing seat 5*a* of another overlying pallet 1.

At the same time, the lower face 4 comprises at least one contact surface 9 adapted to interact with the abutment surface 8 of another underlying pallet 1.

In a stacking configuration, the lower face 4 of a pallet 1 remains lifted with respect to the bottom wall 7 of the underlying pallet 1.

The term "stacking configuration" refers to the configuration in which two or more pallets 1 are stacked on top of each other with the lower face 4 of one pallet 1 facing the upper face 3 of another pallet 1.

In this way, the pallet 1 also allows easy separation of the stacked pallets 1 through the use of special transfer vehicles of the pallet itself.

In the stacking configuration, the abutment surface 8 is then in contact with the contact surface 9.

Advantageously, the main body 2 comprises a plurality of support feet 10 each defining a respective contact surface 9.

The support feet 10 are protruding from the lower face 4.

At the same time, the upper face 3 comprises a plurality of containment seats 5, each of which defines at least one relevant abutment surface 8. In the stacking configuration, each of the contact surfaces 9 is adapted to interact with a corresponding abutment surface 8 of the underlying pallet 1.

In the stacking configuration, each support foot 10 then interacts with a corresponding containment seat 5.

Conveniently, each containment seat 5 has a plurality of abutment surfaces 8, and each support feet 10 defines a plurality of contact surfaces 9, wherein each of the abutment surfaces 8 is adapted, in the stacking configuration, to interact with a corresponding contact surface 9 of the overlying pallet 1.

The abutment surfaces 8 can be substantially horizontal and/or inclined with respect to a horizontal plane.

In turn, the contact surfaces 9 are substantially parallel to the corresponding abutment surfaces 8.

In the embodiment shown in the figures, the pallet 1 has some containment seats 5 wherein the abutment surfaces 8 are all substantially horizontal and some containment seats 5 having at least one of the abutment surfaces 8 inclined.

Appropriately, the support feet 10 are at least partly substantially complementary to the portions of the relevant containment seats 5 within which they are inserted. In other words, the support feet 10 are complementary to the housing seat 5*a*.

Each of the support feet 10 further comprises a supporting surface 11 adapted to support the pallet 1 on a receiving surface such as, e.g., the ground.

Conveniently, the pallet 1 comprises at least a first row of support feet 10 aligned with each other along a first direction D1.

In accordance with the embodiment shown in the figures, the pallet 1 has a substantially rectangular plan and the first direction D1 is substantially parallel to one of the sides of the pallet 1.

At the same time, each of the support feet 10 also has a substantially rectangular plan which develops along the first direction D1.

The pallet 1 also comprises a plurality of first rows of support feet 10 arranged parallel to each other, where the support feet 10 of each of the first rows are arranged mutually aligned with the support feet 10 of the adjacent first rows, along a second direction D2 substantially perpendicular to the first direction D1 to define a plurality of second rows.

The lower face 4 has at least one recess 12,13 positioned between two consecutive support feet 10 and defining a respective surface 12*a*, 13*a*.

Advantageously, in the stacking configuration, the surface 12*a*, 13*a* of the recess 12,13 is lifted with respect to the upper edge 6 of the underlying pallet 1, so as to define at least one free port 14,15 positioned between them.

More specifically, the distance between the abutment surface 8 and the upper edge 6 is less than the distance between the surface 12*a*, 13*a* of the recess 12,13 and the supporting surface 11 of the support foot 10.

Specifically, the width of the free port 14,15 is greater than a predefined value. The free port 14,15 allows the insertion of the transfer vehicles of the pallet 1, such as the forks of a forklift truck, inside it, so as to carry out the separation and lifting of the overlying pallets 1.

The recesses 12,13, in turn, comprise at least a first recess 12 defined between two support feet 10 side by side along the first direction D1.

In more detail, the recesses 12,13 comprise a plurality of first recesses 12 aligned with each other along the first direction D1.

The recesses 12,13 also comprise at least a second recess 13 defined between two support feet 10 side by side along the second direction D2.

In more detail, the recesses 12,13 comprise a plurality of second recesses 13 aligned with each other along the second direction D2.

In the stacking configuration, therefore, the pallets 1 define a plurality of first free ports 14 along the first direction D1 and a plurality of second free ports 15 along the second direction D2.

The pallet 1, therefore, allows easy pickup by the transfer vehicles from all sides of the pallet itself and avoids unnecessary ancillary movements.

Usefully, the pallet 1 comprises a plurality of pickup portions 23 defined on the lower face 4 and adapted to interact with the transfer vehicles of the pallet 1.

The pickup portions 23 protrude from the lower face 4.

Each of the pickup portions 23 is positioned between two consecutive support feet 10.

The pickup portions impart high mechanical strength to the pallet at the areas which interact with the transfer vehicles and are, in general, most subject to mechanical stress.

In accordance with the embodiment shown in the figures, each of the pickup portions 23 is positioned between two support feet 10 aligned along the first direction D1.

In combination or alternatively thereof, the pickup portions 23 can also be defined between two support feet 10 aligned along the second direction D2.

Again with reference to the embodiment shown in the figures, the pickup portions 23 define the first recesses 12 and the relevant first surfaces 12*a*. In detail, the first surfaces 12*a* are arranged at an intermediate height between the lower face 4 and the contact surfaces 9.

The second recesses 13 and the relevant second surfaces 13*a*, on the other hand, are defined by the stiffening beads 22.

Advantageously, the second rows of support feet 10 comprise at least two side rows and at least one central row positioned between two side rows, where the support feet 10 of the central row have an extension along the first direction D1 that is greater than the extension of the support feet 10 of the side rows along the first direction D1.

Specifically, the support feet 10 of the central row have an extension along the first direction D1 that is at least twice the support feet 10 of the side rows.

Again, the supporting surface 11 of the support feet 10 of the central row is greater than the supporting surface 11 of the support feet 10 of the side rows.

This conformation makes it possible to increase the contact area of the pallet 1 at the central part of the holding base 21, this being the part where the weight of the manufactured articles to be transported is generally most concentrated.

Usefully, each containment seat 5 also comprises at least one containment wall 16 positioned between the abutment surface 8 and the bottom wall 7 and adapted to laterally bound the containment seat itself.

In the stacking configuration, the supporting surface 11 of an overlying pallet 1 is arranged to close the relevant containment seat 5 at the top. More particularly, each containment seat 5 also comprises at least one side wall 18 positioned between the upper edge 6 and the abutment surface 8 and bounding the housing seat 5*a*.

In turn, each of the support feet 10 also comprises at least one outer wall 19.

In the stacking configuration, the side wall 18 faces the outer wall 19 of an overlying pallet 1 and they define a gap 20 between them.

The gap 20 allows the protrusion to be kept spaced apart from the corresponding containment seat 5 so as to facilitate the separation of the pallets 1. In fact, the gap allows the frictional forces between the surfaces of the pallets 1 to be reduced, promoting the separation thereof.

The outer wall 19 and the side wall 18 are substantially parallel to each other. Specifically, the outer wall 19 and the side wall 18 are substantially vertical.

It has in practice been ascertained that the described invention achieves the intended objects, and in particular, the fact is emphasized that the pressed wood pallet according to the invention allows a practical and easy separation of one pallet from a plurality of pallets stacked on top of each other.

In fact, the presence of the free port 14,15 and of the gap 20 promote decoupling between the support feet 10 and the containment seats 5.

In particular, this pressed wood pallet allows convenient pickup of one pallet from a plurality of pallets stacked on top of each other even through the use of special transfer vehicles. In fact, due to the free port 14,15 having greater width than a predefined value, the transfer vehicles such as forklift and pallet trucks can easily fit underneath the pallet to interact therewith and lift it.

At the same time, the gap allows for a reduction in the force required to separate the pallets. In fact, this pallet requires minimal effort by the operator to separate a plurality of pallets stacked on top of each other.

Finally, the aforementioned advantages also prevent pallets from breaking and/or damaging during pallet separation operations.

The invention claimed is:

1. A pressed wood pallet for support of manufactured articles including at least one main body made of a mixture of loose wooden material and adhesive materials, wherein said at least one main body is made in a single body piece and is provided with a holding base intended to receive and support one or more manufactured articles, said pressed wood pallet comprising:

at least one upper face defining at least one containment seat open at a top, bounded by an upper edge and having a bottom wall; and at least one lower face opposite said at least one upper face, wherein said at least one containment seat has at least one abutment surface positioned between said upper edge and said bottom wall so as to define a housing seat of an overlying pallet and said at least one lower face comprises at least one contact surface adapted to contact the at least one abutment surface of an underlying pallet, where, in a stacking configuration, said at least one lower face remains lifted with respect to the bottom wall of the underlying pallet, wherein said at least one main body comprises a plurality of support feet protruding from said at least one lower face, each foot defining at least one corresponding contact surface and wherein said at least one upper face comprises a plurality of said at least one containment seats, each of which defining at least one corresponding abutment surface, where said at least one contact surface is/are adapted to interact with said at least one abutment surface in the stacking configuration;

the pressed wood pallet further comprising: at least a first row of said plurality of support feet arranged aligned with each other along a first direction and a plurality of said first rows of said plurality of support feet arranged parallel to each other, where the plurality of support feet of each of said first rows are arranged mutually aligned with the plurality of support feet of the adjacent first rows, along a second direction substantially perpendicular to said first direction to define a plurality of second rows, and wherein said second rows of said plurality of support feet comprise at least two side rows and at least one central row positioned between two of said at least two side rows, where the said plurality of support feet of said at least one central row have an extension along said first direction that is greater than the extension of the plurality of support feet of said at least two side rows along said first direction.

2. The pressed wood pallet according to claim 1, wherein said at least one lower face has at least one recess positioned between two of said plurality of support feet and defining a corresponding surface, and, in said stacking configuration, the corresponding surface of said at least one recess is lifted with respect to the upper edge of said underlying pallet so as to define at least one free port between them.

3. The pressed wood pallet according to claim 2, wherein a width of said free port is greater than a predefined value.

4. The pressed wood pallet according to claim 3, wherein said recesses comprise at least a first recess defined between two of said plurality of support feet positioned side by side along said first direction.

5. The pressed wood pallet according to claim 4, wherein said recesses comprise at least a second recess defined between two of said plurality of support feet positioned side by side along said second direction.

6. The pressed wood pallet according to claim 5, wherein said at least one abutment surface is substantially horizontal.

7. The pressed wood pallet according to claim 2, further comprising: a plurality of pickup portions defined on said at least one lower face and adapted to interact with transfer vehicles of said pallet, said plurality of pickup portions protruding from said at least one lower face.

8. The pressed wood pallet according to claim 7, wherein each of said plurality of pickup portions is positioned between two consecutive support feet.

9. The pressed wood pallet according to claim 8, wherein each of said plurality of pickup portions is positioned between two support feet aligned along said first direction.

10. The pressed wood pallet according to claim 4, wherein said plurality of pickup portions define said first recesses and the corresponding first surfaces.

11. The pressed wood pallet according to claim 1, wherein said at least one abutment surface is inclined with respect to a horizontal plane.

12. The pressed wood pallet according to claim 1, wherein said at least one containment seat comprises at least one containment wall positioned between said at least one abutment surface and said bottom wall and laterally bounding the at least one containment seat and said plurality of support foot comprises at least one supporting surface adapted to support said pallet on a receiving surface, wherein, in said stacking configuration, the at least one supporting surface of an overlying pallet is arranged to close the at least one containment seat at a top wherein the supporting surface is inserted.

13. The pressed wood pallet according to claim 1, wherein said at least one main body comprises a plurality of stiffening beads formed into said holding base and defining a series of concavities on said at least one upper face and a series of corresponding convexities on said at least one lower face, said stiffening beads being communicating with each other.

* * * * *